United States Patent [19]

Flesburg

[11] 4,004,779

[45] Jan. 25, 1977

[54] WINCH AND FLUID CONTROL SYSTEM THEREFOR

[75] Inventor: Edward E. Flesburg, Peoria, Ill.

[73] Assignee: Caterpillar Tractor Co., Peoria, Ill.

[22] Filed: May 5, 1975

[21] Appl. No.: 574,807

[52] U.S. Cl. ..... 254/187.4; 91/413; 192/18 A

[51] Int. Cl.[2] ..... B66D 1/00

[58] Field of Search ..... 254/187 D, 187 H, 187 G, 254/166, 150 FH, 167, 168; 137/625.42, 625.69, 625.67; 91/413; 192/18 R, 18 A

[56] References Cited

UNITED STATES PATENTS

| | | | |
|---|---|---|---|
| 2,984,258 | 5/1961 | Clary | 91/413 |
| 2,986,884 | 6/1961 | Smith | 254/150 FH |
| 3,601,235 | 8/1971 | Huf | 254/150 FH |
| 3,726,186 | 4/1973 | Wheeler et al. | 91/413 |
| 3,758,079 | 9/1973 | Workman, Jr. | 254/168 |
| 3,841,608 | 10/1974 | Schmitt et al. | 254/166 |

*Primary Examiner*—Robert J. Spar
*Assistant Examiner*—Kenneth Noland
*Attorney, Agent, or Firm*—Phillips, Moore, Weissenberger, Lempio & Strabala

[57] ABSTRACT

A rotatable drum for reeling in and releasing a cable has drive means which includes a normally disengaged drive input clutch, a normally engaged brake and a normally engaged disconnect clutch which may be used to uncouple the drum from the drive system so that it may be turned manually to withdraw cable. The input clutch may be selectively engaged and the brake and disconnect clutch may each be selectively disengaged by fluid pressure from a control valve connected to a source of fluid pressure. The valve has a Hold or Brake-On position at which each of the clutches and the brake are unpressurized, a Reel-In position at which the input clutch and the brake are pressurized, a Brake-Off position at which only the brake is pressurized and further has a Free-Spool position at which the disconnect clutch is pressurized to free the drum from the resistance or drag of the drive system. Centering springs resist movement of the control valve away from the Brake-On position. To facilitate manual control of the valve, additional resilient means are arranged to create added resistance to further movement of the control valve as it approaches the Free-Spool position to assist the operator in avoiding overshifting to that position when it is not desired.

6 Claims, 4 Drawing Figures

WINCH AND FLUID CONTROL SYSTEM THEREFOR

BACKGROUND OF THE INVENTION

This invention relates to winches having a powered rotatable drum for winding in and releasing a cable or the like and more particularly to a winch system of the type in which the drum is driven and controlled by means of fluid pressure-operated clutches and brakes.

Prior copending application Ser. No. 334,354 of L. F. Yates et al, filed Feb. 21, 1973 for "WINCH WITH FREE-WHEELING DRUM" and assigned to the assignee of the present application, discloses a winch assembly which is driven by an engine through a drive train having a normally disengaged input clutch which engages in response to fluid pressure to reel in cable. The drive train also includes a normally engaged brake for immobilizing the winch drum but which releases in response to fluid pressure in other modes of operation. In addition to the Brake-On and Reel-In modes of operation, the brake alone may be pressurized to effect a Brake-Off mode in which load forces pulling on the line may unwind cable against the limited resistance created by the drag of the drive train components. This limited resistance prevents excess unwinding of a cable by a load, from drum momentum or other causes, but is sufficiently strong that it is difficult or impossible to withdraw cable manually while such resistance is present. Accordingly, the drive train connects to the winch drum itself through a disconnect clutch which is normally engaged but which may be disengaged by fluid pressure to allow manual unreeling of cable from the drum without working against a substantial resistance. This form of winch assembly is highly useful on a log skidder vehicle, for example, which is used to drag logs from the site of a lumbering operation and also has substantial advantages in other contexts.

Prior U.S. Pat. No. 3,841,608 discloses a hydraulic control system for a winch assembly of this kind in which a manually operated control valve may be shifted between a series of positions to pressurize and depressurize appropriate ones of the clutches and brake of the drive train in order to accomplish the several operational modes described above. The valve settings include Reel-In, Brake-On, Brake-Off and Free-Spool and are realized by movement of a control lever or the like. For safety reasons as well as for convenience of operation, centering springs urge the control valve towards the Brake-On position so that if the operator releases his control lever or the like, the winch is automatically immobilized.

The operator of these winch systems must pay careful attention to the position of his control lever or the like in order to control movement of a load in a safe and efficient manner. It is particularly important to avoid movement of the lever into the Disconnect position through misjudgment while a load is pulling on the cable since momentum and overtravel may cause an excessive amount of cable to be released, creating unwanted slack, when dropping of the load stops or slows. Diversion of the operator's visual attention in order to guard against this occurrence is undesirable in many cases, particularly in such usages as on a long skidder where the operator must pay attention to controlling the vehicle itself in addition to operating the winch.

In order to guard against inadvertent movement of the control lever into the Free-Spool position, the lever has been heretofore constrained to pivot along a slot in a console which includes an angled section whereby sideward movement is needed before the lever movement can be continued into the Free-Spool position from the adjacent position. While this arrangement accomplishes the objective of alerting the operator when the lever approaches the Free-Spool position, it also undesirable complicates lever manipulations and delays shifting into the Free-Spool mode at times when fast action may be required.

SUMMARY OF THE INVENTION

This invention provides a winch system having a plurality of modes of operation, including a Free-Spool mode at which there is little resistance to turning of the winch drum, which are initiated by movement of a single control lever. Means are provided which enable the operator to determine when the control lever is approaching the Free-Spool position without necessarily relying on visual observation for this purpose and without complicating the lever movement pattern.

Accordingly, it is an object of this invention to facilitate the operation of hydraulically controlled winch systems.

It is another object to provide means enabling a winch operator to sense when the control lever or the like approaches a position at which the winch drum will be released for relatively unimpeded rotation, which means does not require a complicated lever shift pattern nor significantly delay lever movements.

It is another object of this invention to provide a winch system having a control lever movable through a series of positions for initiating different winch operations to a disconnect position at which cable may be unwound from the winch drum without significant impedance wherein the resistance to control lever and valve movement abruptly increases just prior to reaching the disconnect position.

The invention, together with further objects and advantages thereof, will best be understood by reference to the following description of a preferred embodiment taken in conjunction with the accompanying drawings.

BRIEF DESCRIPTION OF THE DRAWINGS

In the accompanying drawings:

FIG. 3 may be juxtaposed end-to-end with FIG. 2 to form a single figure in which fluid conduit interconnections between the control valve and winch system are readily apparent.

DESCRIPTION OF A PREFERRED EMBODIMENT

Figure 1:
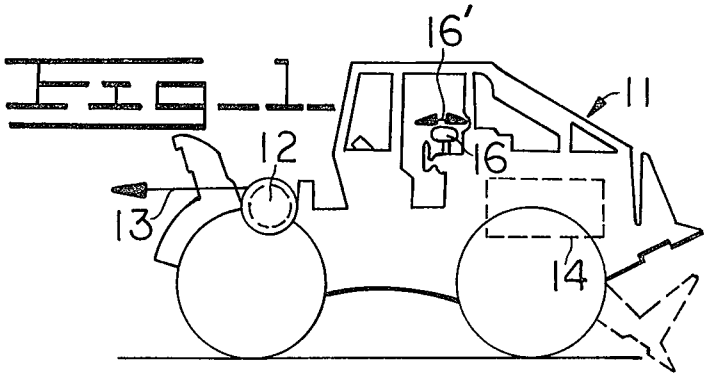
FIG. 1 is a side elevation view of a log skidder vehicle equipped with a winch system in accordance with the present invention.

The winch system of the present invention was initially developed for use on a log skidder vehicle and will therefore be described in that particular context for purposes of example, it being apparent that the apparatus may also be employed on diverse other forms of load-manipulating equipment. Referring initially to FIG. 1, a log skidder vehicle 11 is normally used in lumbering operations primarily for dragging heavy logs away from the site of tree-felling operations. For this purpose, the vehicle is provided with a rotatable winch drum 12 having a length of cable 13 wound thereon.

As is understood by those skilled in the art, it is necessary at times to immobilize the winch drum 12 so that the vehicle may be used to drag a log while at other times cable 13 must be reeled in by driving the drum from a suitable engine such as the vehicle engine 14. At other times it is necessary to release cable from the winch drum 12. If the cable is to be withdrawn from the drum by the weight of the load pulling on the cable, it is desirable that there be some limited resistance to drum rotation. Such resistance prevents overly fast or erratic release of cable and prevents momentum from causing an excess amount of cable to be released when load movement slows or stops. However, there is another cable release mode of operation in which any sizable resistance to rotation of the winch drum 12 is undesirable. This occurs when there is no load fastened to the cable 13 and it is necessary to manually withdraw cable from the drum 12. Under those circumstances, it is desirable that the operator not have to pull against any significant resistance.

The above-identified prior copending application Ser. No. 334,354 and prior U.S. Pat. No. 3,841,608 respectively disclose a winch mechanism construction and a hydraulic control system therefor and the present system may be essentially similar except for the control valve modifications to be hereinafter described. In this form of winch system, an operator may manipulate a single control lever 16 to establish any of the above-described modes of winch operation. The control lever 16 is pivotable along an arc 16' and has a centered position which is the Brake-On position at which the winch drum is immobilized. The lever 16 may be pivoted backward to a Reel-In position and may be pivoted forward to a Brake-Off position at which cable may be withdrawn by load forces pulling on the cable although substantial resistance to such withdrawal must be overcome for reasons to be hereinafter described. In order to free the winch drum from any significant resistance so that cable may readily be withdrawn manually, the control lever may be shifted through the Brake-Off position to an extreme forward setting which is the Free-Spool position. As will hereinafter be described the present invention provides means which substantially increases the resistance to forward lever movement just prior to entering the Free-Spool position to assure that the operator is aware that the lever is about to go to that position.

Figure 2:
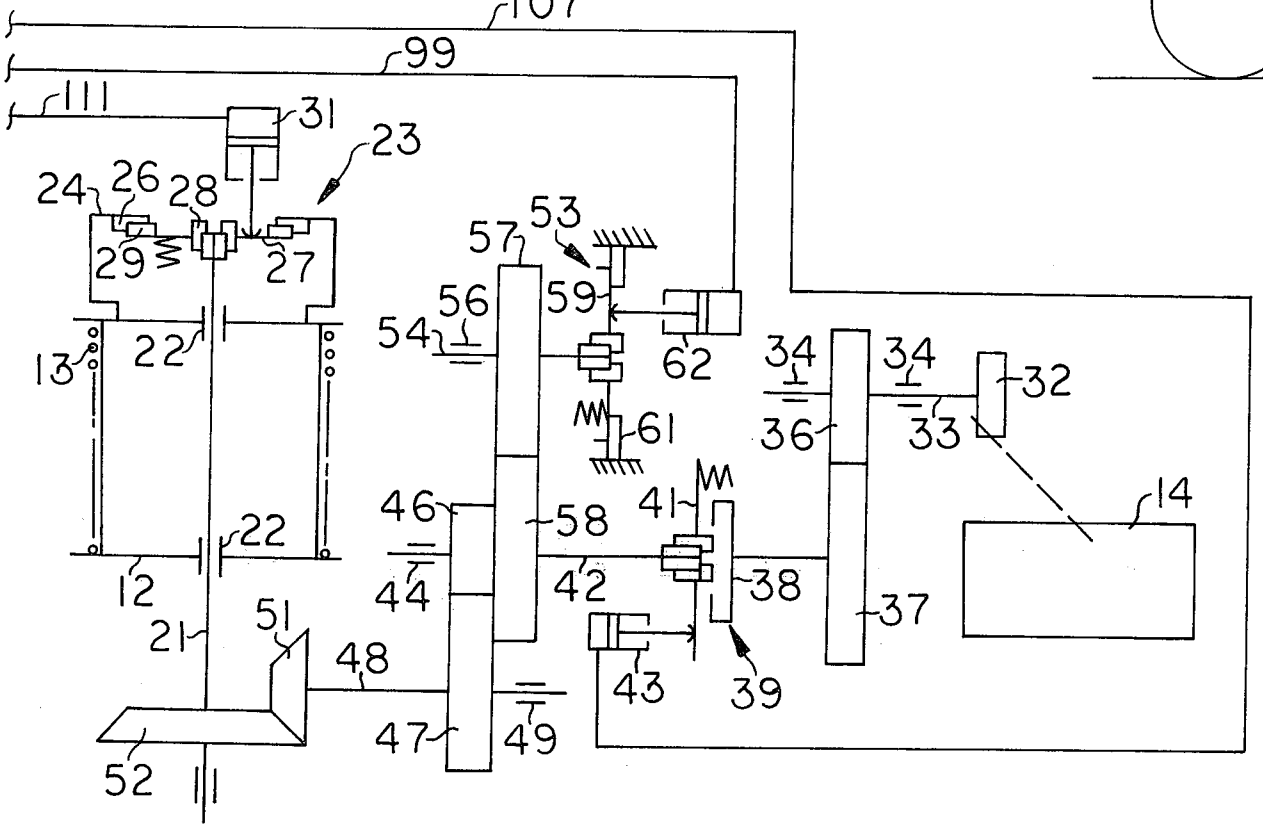
FIG. 2 is a schematic diagram of the winch system of FIG. 1 showing the interconnection of drive train and control mechanism elements between the winch drum and the driving engine.

Referring now to FIG. 2, the winch drum 12 may be supported on a rotatable drive shaft 21 by bearings 22. Except in the Free-Spool mode of operation, the drum 12 is caused to rotate with the drive shaft by a normally engaged jaw clutch 23. Clutch 23 may be of the known form in which an annular member 24 carrying teeth 26 is coupled to the drum while another member 27 is coupled to drive shaft 21 through splines 28 which enable axial movement relative to the drive shaft. Member 27 carries teeth 29 and is spring-biased to a position at which the teeth 29 engage teeth 26. The jaw clutch 23 may be selectively disengaged by pressurization of a fluid actuator 31 which then forces the member 27 out of engagement with member 24 to disconnect the drum from the drive shaft.

To transmit drive from engine 14 to drum 12 when it is desired to reel in cable, the engine turns a winch system input member 32 which is secured on an input shaft 33 that is in turn supported by bearings 34. Shaft 33 also carries a transfer gear 36 which engages another transfer gear 37 to transmit drive to an input member 38 of normally disengaged input clutch 39 of the friction disc type. Clutch 39 has one or more output discs 41 which are spline-connected to an output shaft 42 for axial movement thereon and which are spring-biased towards a position at which the disc or discs free of engagement with input member 38. Input clutch 39 may be selectively engaged by pressurizing a fluid actuator 43 which then urges output disc 41 towards input member 38 to effect engagement.

Shaft 42, supported by another bearing 44, carries a transfer gear 46 which engages another transfer gear 47 secured to a shaft 48 which is supported by still another bearing 49. Drive is transmitted from shaft 48 to the winch drum drive shaft 21 through a bevel gear 51 on shaft 48 which engages another bevel gear 52 on shaft 21.

To provide for immobilizing the winch drum when necessary, a normally engaged brake mechanism 53 is coupled to shaft 42 through a rotatable brake shaft 54 that is supported by a bearing 56. Shaft 54 carries a gear 57 which engages another gear 58 carried on shaft 42. Brake mechanism 53 may be of the friction disc type which includes one or more brake discs 57 spline-coupled to brake shaft 54 for axial movement thereon and spring-biased towards a position at which each disc 59 is urged against a stationary brake disc 61. Brake mechanism 53 may be selectively disengaged by pressurization of a fluid actuator 62 which then urges disc 59 away from disc 61.

With all actuators 31, 43 and 62 unpressurized, the system is in the Brake-On mode of operation at which winch drum 12 is immobilized by brake 53. By pressurizing actuators 43 and 62, the Reel-In mode is established at which drive is transmitted to drum 12 to reel in cable. When a load is pulling on the cable 13, cable may be released by pressurizing only actuator 62 to disengage brake 53. In this mode of operation, there is a limited degree of resistance to release of the cable due to the drag created by the frictional resistance and inertia of the gearing system coupled to the drum through disconnect clutch 23. That resistance is typically sufficiently high that it is very difficult or impossible to manually withdraw cable from the drum when there is no load pulling on the cable. To facilitate such manual withdrawal of cable, actuator 31 may be pressurized to establish the Free-Spool mode at which the drum is uncoupled from drum drive shaft 21 and the other elements of the drive train.

Figure 3:
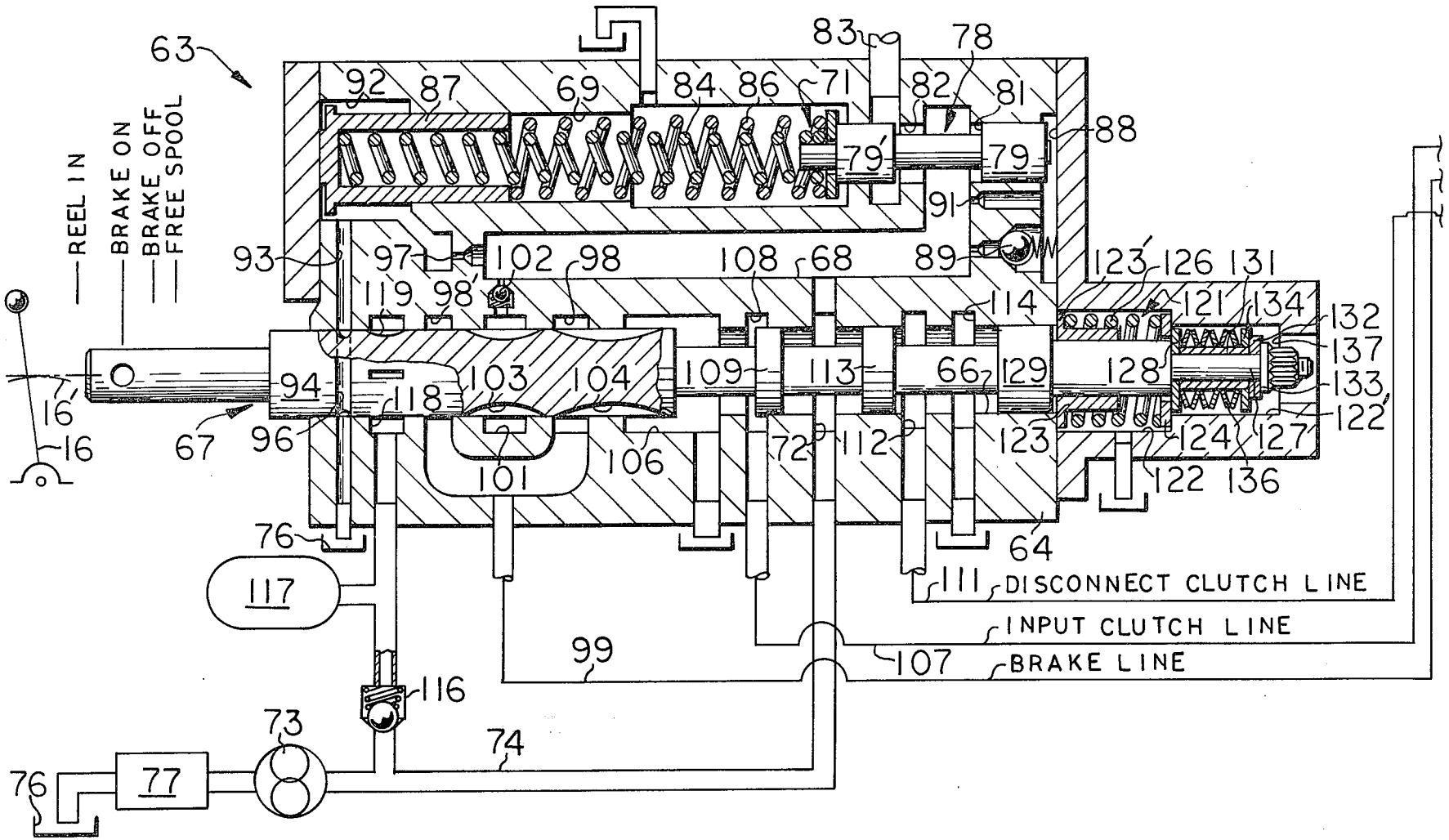
FIG. 3 is a sectional view of a control valve for supplying appropriate fluid pressures to control mechanisms of FIG. 2 in response to movement of an operator's control lever and showing the valve in the Brake-On position at which the winch drum is immobilized.

Referring now to FIG. 3, there is shown a control valve 63 through which the clutch and brake actuators 31, 43 and 62 may be selectively pressurized by movement of the operator's control lever 16 to effect any of the above modes of winch operation, the control valve being shown at the Brake-On position at which all actuators are unpressurized. Control valve 63 has a valve body 64 with a bore 66 in which a valving element formed by a spool 67 is disposed. Spool 67 is shiftable along the axis of bore 66 by pivoting of control lever 16.

Valve body 64 has a fluid inlet chamber 68 and an additional bore 69 in which a pressure-modulating relief valve assembly 71 is disposed. A groove 72 in bore 66 is communicated with inlet chamber 68 and receives pressurized fluid from a pump 73 through a conduit 74. Pump 73, which may be driven by the previously described vehicle engine or other means, draws fluid from a tank 76 through a filter 77.

Modulating relief valve assembly 71 functions to establish a fluid pressure in inlet chamber 68 which is normally at a predetermined level sufficient to fully actuate the previously described clutches and brake through the associated actuators but also functions to drop the pressure in inlet chamber 68 to a lower level when the spool 67 is shifted to the Brake-On position and thereafter to produce a gradual rise of the pressure back up to the maximum level following movement of the spool away from the Brake-On position in either direction. This modulating action causes a gradual engagement or disengagement of the clutches and brake and thereby reduces shocks and stresses in the drive system.

The modulating relief valve assembly may include a spool 78 having a pair of lands 79 and 79' separated by a groove 81, the spool being disposed for axial movement in a reduced-diameter extension 82 of bore 69. Bore extension 82 is communicted with inlet chamber 68 and, in conjunction with an edge of spool land 79', forms a flow metering passage through which fluid from the inlet chamber may be released to a discharge conduit 83 to regulate system pressure. A pair of coaxial springs 84 and 86 extend within bore 69 between the end of the spool 78 and a load piston 87 at the opposite of the bore 69 to urge the spool to a position at which land 79' blocks the release of fluid from bore extension 82. The force of springs 84 and 86 on spool 78 is opposed by fluid pressure in another chamber 88 which receives fluid from inlet chamber 68 through a check valve 89. Fluid may be gradually released from chamber 88 back into the inlet chamber 68 through a restricted flow orifice 91.

Thus the position of valve spool 78 is determined by the extent to which the fluid pressure in chamber 88 acting on the spool is able to overcome the opposed force of springs 84 and 86 on the spool and thereby permit a controlled release of fluid from inlet chamber 68. The springs are selected to establish a predetermined base pressure within the inlet chamber 68 which is low in relation to the pressure required to fully actuate the previously described clutches and brake. Thus, with the load piston 87 fully to the left as viewed in FIG. 3, the fluid pressure within the chamber 88 is able to shift spool 78 sufficiently to discharge fluid from inlet chamber 68 at a rate which keeps the inlet chamber pressure at a low value. If load piston 87 is then shifted rightwardly to increase the spring force on valve spool 78, the pressure within the inlet chamber 68 and in chamber 88 must rise to a higher value in order to force the spool 78 to the position at which fluid can continue to be released. Thus system pressure may be raised in a modulated manner by shifting load piston 87 progressively to the right as viewed in FIG. 3.

To control the load piston 87 so that system pressure is minimal at the Brake-On setting of lever 16 and rises in a modulated manner when the lever is moved away from that position in either direction, a chamber 92 behind the load piston at the end of bore 69 is communicated with the tank 76 through a passage 93 which extends across valve spool bore 66. Valve spool 67 has a land 94 which blocks flow through passage 93 at any position of spool 67 other than the Brake-On position. At the Brake-On position, a groove 96 on land 94 enables fluid to discharge from load piston chamber 92 through passage 93.

Load piston chamber 92 receives fluid from inlet chamber 68 through a flow orifice 97. This flow of pressurized fluid into the load piston chamber 92 does not move the load piston 87 when control spool 67 is in the Brake-On position since the load piston chamber is vented at that time through drain passage 93 and spool groove 96. However, if the control spool 67 is shifted away, in either direction, from the Brake-On position, drain passage 93 is blocked. The flow of pressurized fluid through orifice 97 then gradually raises the pressure in chamber 92 causing the load piston 87 to move to the right as seen in FIG. 3 thereby gradually raising the system pressure within inlet chamber 68 as described above. Accordingly, a shift of the control lever 16 in either direction away from the Brake-On position is followed by a modulated rise of system pressure within inlet chamber 68. The pressure then remains at a high level until control spool 67 is again shifted to the Brake-On position at which the pressure behind the load piston 87 is relieved.

Considering now the action of the valving element spool 67 in distributing pressurized fluid to appropriate ones of the clutches and brake at the various positions of the spool, bore 66 has a pair of spaced-apart interconnected grooves 98 and 98' which are communicated with the brake actuator 62 of FIG. 2 through a brake line 99. Referring again to FIG. 3, bore 66 has an additional groove 101 situated between grooves 98 and 98' and which receives pressurized fluid from inlet chamber 68 through a check value 102. Spool 67 has a series of flow-metering grooves 103 located to increasingly release pressurized fluid from groove 101 into groove 98 or 98' when the control spool is shifted in either direction away from the Brake-On position to pressurize the brake actuator and thereby release the brake at all other valve settings. An adjacent set of metering slots 104 on spool 67 communicate groove 98 with an adjacent drain groove 106 when the spool is at the Brake-On position thereby depressurizing the brake actuator and engaging the brake.

To pressurize a line 107 communicated with input clutch actuator 43 at the Reel-In position of lever 16 while venting that actuator to tank at all other positions of the lever, bore 66 has still another groove 108 communicated with line 107 and situated between the previously described fluid supply groove 72 and drain groove 106. Spool 67 has an additional land 109 positioned to block groove 108 from the supply groove 72 while communicating groove 108 with drain groove 106 at the Brake-On position of spool 67 and also at the Brake-Off and Free-Spool positions which are realized by rightward movement of spool 67 from the Brake-On position as viewed in FIG. 3. When the control spool 67 is shifted leftwardly to the Reel-In position, land 109 blocks groove 108 from the drain groove 106 and then communicates groove 108 with inlet groove 72 to pressurize the input clutch line 107.

The disconnect clutch pressurization line 111 is communicated with still another groove 112 of bore 66. Another land 113 of control spool 67 is positioned to block groove 112 from supply groove 72 while communicating groove 112 with an adjacent drain groove 114 at all positions of spool 67 other than the Free-Spool position which is realized by moving the spool to the extreme rightward position as viewed in FIG. 3. Accordingly, the disconnect clutch actuator is pressurized to release the winch drum for unresisted rotation only at the Free-Spool position of the control valve.

If the pump 73 which supplies pressurized fluid to the system should stop operating because of malfunction of the driving engine or for some other reason, the loss of pressure in the several actuator lines 99, 107 and 111 will automatically bring about the Brake-On condition at which the winch drum is immobilized. However, under this condition there may be circumstances at which the operator desires to controllably release cable from the winch to relieve the force of the load on the cable. To enable release of the brake for this purpose, another check valve 116 transmits fluid from pump 73 to an accumulator 117 which is communicated with still another groove 118 of bore 66. Metering slots 119 are positioned on spool land 94 to transmit pressurized fluid from the accumulator to groove 98' only when the spool 67 is shifted fully to the right, as seen in FIG. 3, to the Free-Spool position. This does not interfere with operation of the system when pump 73 is delivering pressurized fluid since groove 98' is already pressurized at the Free-Spool position by other means as described above. Although the control valve is shifted to the Free-Spool position for the above-described special purpose, it should be observed that a true Free-Spool mode of operation does not result in the absence of system pressure since the disconnect clutch line lll cannot be pressurized under that circumstance.

Figure 4:
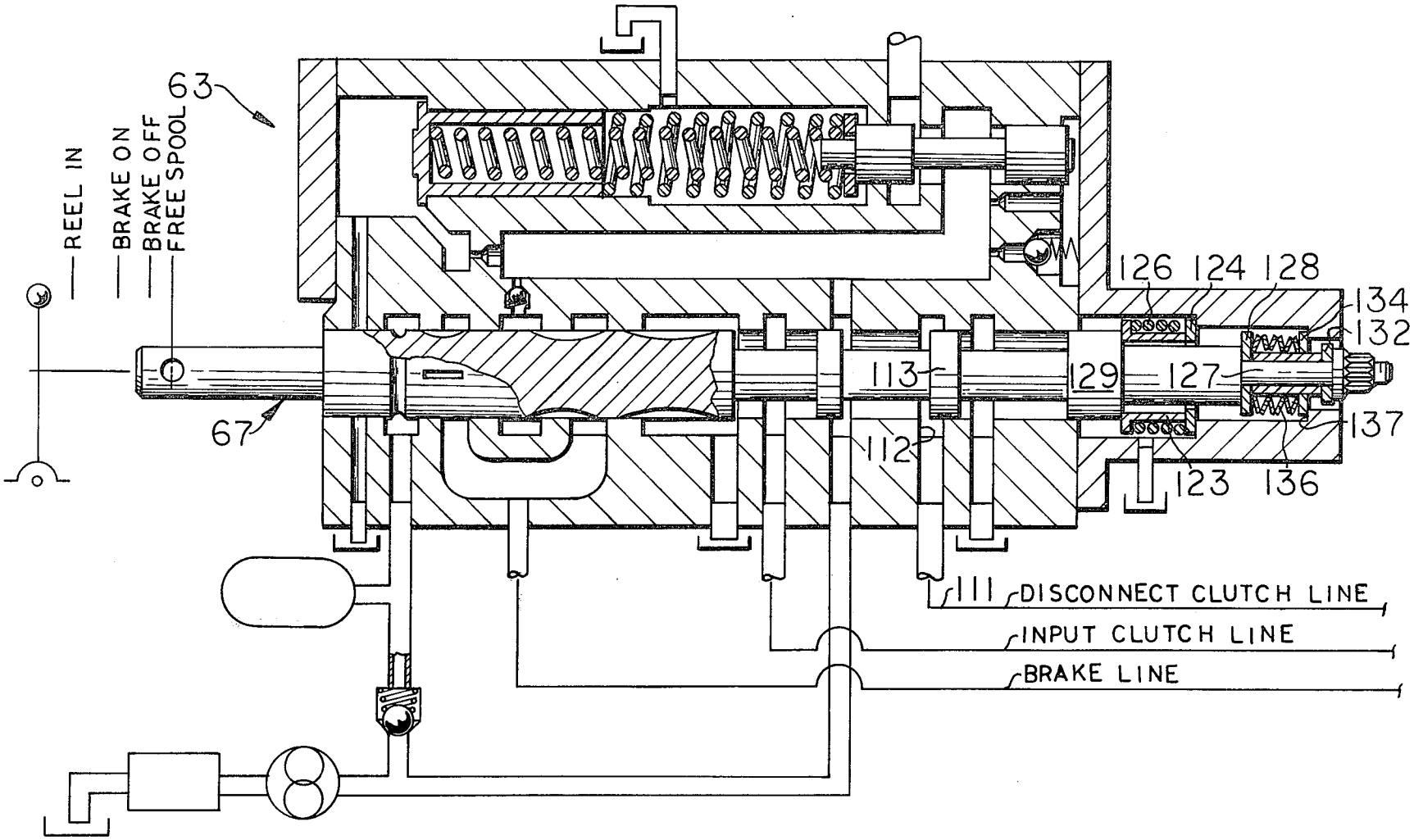
FIG. 4 is a sectional view of the control valve of FIG. 3 after shifting to a Free-Spool position at which there is no significant resistance to turning of the winch drum and at which cable may readily be withdrawn from the winch drum.

From the foregoing it may be seen that the clutch and brake pressurization and depressurization needed to effect the several described modes of winch operation may be realized by simply shifting the operator's control lever 16 between the appropriate one of the four positions of the lever. In order to restore the valving element spool 67 and lever 16 to the Brake-On position automatically when the lever is released a centering spring assembly 121 is situated in a chamber 122 adjacent the end of bore 66. Chamber 122 is of larger diameter than the adjacent end of bore 66 and contains a sleeve 123 having a flange 123' at the end adjacent bore 66, the end of the spool 67 being extended through the sleeve in coaxial relationship therewith. Chamber 122 also contains an annular element 124 through which the end of spool 67 extends and a centering spring 126 which extends between the flange of sleeve 123 and the annular element 124 in coaxial relationship with the spool end. A sub-chamber 122' forms a lesser-diameter extension of chamber 122 and a bolt 127 extends axially from the end of spool 67 within sub-chamber 122' and has a washer 128 disposed coaxially thereon adjacent the end of the spool. Spring 126 urges sleeve 123 and annular member 124 in opposite directions. Movement of sleeve 123 is limited by abutment of the flange 123' against one end of chamber 122 while movement of annular member 124 is limited by abutment against the other end of the same chamber. As annular member 124 bears against washer 128 while sleeve flange 123' may exert a force against an adjacent land 129 of spool 67 the effect of the centering spring assembly is to continually urge the spool 67 towards the Brake-On position. If the spool 67 is shifted rightwardly as viewed in FIG. 3, land 129 acting through sleeve 123 tends to compress spring 126 while if the spool is shifted in the opposite direction, washer 128 acting through annular member 124 again tends to compress the spring. Spool travel is limited in either direction by abutment of sleeve 123 against annular member 124 as shown in FIG. 4.

Considering now the means which acts to produce an abrupt, kinesthetically detectable increase in the resistance to movement of spool 67 and control lever 16 as the Free-Spool position is approached, with reference again to FIG. 3, a sleeve 131 is disposed coaxially around bolt 127 and extends from washer 128 to another washer 132 which in turn abuts an enlarged head 133 on the end of the bolt. An annular element 134 is disposed coaxially on sleeve 131 adjacent washer 132 and a plurality of annular belleville springs 136 of conical section shape are disposed coaxially on sleeve 131 between washers 128 and 134 to resist movement of one washer towards the other with a resilient force. It will be apparent that other forms of spring may extend between the two washers 128 and 134 if desired.

Chamber extension 122' has an internal step 137 positioned to be contacted by annular element 134 upon movement of the valve spool 67 toward the Free-Spool position just prior to the time that position is reached. Accordingly, further movement of the valve spool 67 and control lever 16 into the Free-Spool position can only be accomplished by compressing the belleville springs 136 as illustrated in FIG. 4. This additional resistance to spool movement enables the operator to sense when the winch drum is about to be freed from any significant resistance against rotation so that he may terminate further control lever movement if he does not in fact desire to establish the condition.

While the invention has been described with respect to a particular embodiment, it will be apparent that many modifications are possible and it is not intended to limit the invention except as defined in the following claims.

What is claimed is:

1. A winch and fluid control system comprising:

a rotatable drum for receiving and releasing a cable, drive means for supporting said drum and for selectively transmitting rotary drive thereto, said drive means having a normally disengaged input clutch which engages in response to application of fluid pressure thereto and further having a normally engaged brake for stopping rotation of said drive means and which is releasable by application of fluid pressure thereto and still further having a normally engaged disconnect clutch which disengages said drum from said drive means in response to fluid pressure, a source of pressurized fluid, a control valve having an inlet chamber communicated with said source of pressurized fluid and having a brake fluid outlet and an input clutch outlet and a disconnect clutch outlet connected to said brake and said input clutch and said disconnect clutch respectively, said control valve having a valving element shiftable between at least four positions including a Brake-On position at which said inlet chamber is isolated from each of said outlets and a Reel-In position at which said inlet chamber is communicated with said input clutch outlet and said brake outlet while said disconnect clutch outlet is vented and a Brake-Off position at which said inlet chamber is communicated with said brake outlet while said input clutch outlet and said disconnect clutch outlet are vented, and a Free-Spool position at which said inlet chamber is communicated with said disconnect clutch outlet, resilient centering means for urging said valving element towards said Brake-On position and for resisting movement of said valving element away therefrom, and means for creating additional resistance to further movement of said valving element as said valving element approaches said Free-Spool position thereof, said means for creating additional resistance to movement of said valving element being additional resilient means positioned to be distorted by movement of said valving element only upon movement of said valving element into said Free-Spool position thereof from the next adjacent one of said positions thereof.

2. The combination defined in claim 1 wherein said control valve has a valve body with a bore therethrough and wherein said valving element is a valve spool disposed coaxially in said bore and being axially movable therein between said positions, said valve spool being movable in a first direction from said Brake-On position to said Reel-In position and being movable in an opposite direction from said Brake-On position to first reach said Brake-Off position and then to subsequently reach said Free-Spool position, and wherein said means for creating additional resistance comprises spring means positioned to be compressed by movement of said valve spool in said opposite direction only after passage of said valve spool through said Brake-Off position.

3. The combination defined in claim 2 wherein said spring means is annular and disposed in a spring chamber of said valve body situated adjacent an end of said spool bore, said spring means being disposed in coaxial relationship with said spool.

4. The combination defined in claim 3 wherein said spring means is carried on an extension of said spool within said spring chamber for movement with said spool and wherein means are provided within said spring chamber for stopping continued movement of said spring means with said spool in said opposite direction as said spool is about to enter said Free-Spool position to prevent further travel of said spring means with said spool in said opposite direction whereby said spring means is compressed upon said further travel.

5. A winch and fluid control system comprising:

a rotatable drum for receiving and releasing a cable, drive means for supporting said drum and for selectively transmitting rotary drive thereto, said drive means having a normally disengaged input clutch which engages in response to application of fluid pressure thereto and further having a normally engaged brake for stopping rotation of said drive means and which is releasable by application of fluid pressure thereto and still further having a normally engaged disconnect clutch which disengages said drum from said drive means in response to fluid pressure, a source of pressurized fluid, a control valve having an inlet chamber communicated with said source of pressurized fluid and having a brake fluid outlet and an input clutch outlet and a disconnect clutch outlet connected to said brake and said inlet clutch and said disconnect clutch respectively, said control valve having a valving element shiftable between at least four positions including a Brake-On position at which said inlet chamber is isolated from each of said outlets and a Reel-In position at which said inlet chamber is communicated with said input clutch outlet and said brake outlet while said disconnect clutch outlet is vented and a Brake-Off position at which said inlet chamber is communicated with said brake outlet while said input clutch outlet and said disconnect clutch outlet are vented, and a Free-Spool position at which said inlet chamber is communicated with said disconnect clutch outlet, wherein said control valve has a valve body with a bore therethrough and wherein said valving element is a valve spool disposed coaxially in said bore and being axially movable therein between said positions, said valve spool being movable in a first direction from said Brake-On position to said Reel-In position and being movable in an opposite direction from said Brake-On position to first reach said Brake-Off position and then to subsequently reach said Free-Spool position, resilient centering means for urging said valving element towards said Brake-On position and for resisting movement of said valving element away therefrom, and means for creating additional resistance to further movement of said valving element as said valving element approaches said Free-Spool position thereof, said means for creating additional resistance including spring means positioned to be compressed by movement of said valve spool in said opposite direction only after passage of said valve spool through said Brake-Off position, said spring means being annular and being disposed in a spring chamber of said valve body situated adjacent an end of said spool bore, said spring means being disposed in coaxial relationship with said spool, said valve spool having a reduced-diameter extension within said spring chamber and wherein an annular element is disposed coaxially on said extension for axial movement relative thereto and wherein said spring means is an annular compression spring means disposed coaxially on said extension and having an end bearing against said annular element, said spring chamber having an annular step formed therein in position to stop further travel of said annular element with said spool extension as said spool is moved from said Brake-Off position towards said Free-Spool position whereby said spring means is compressed by said further travel to said Brake-Off position.

6. The combination defined in claim 5 wherein said spring means comprises a plurality of resilient belleville springs disposed along said spool extension in coaxial relationship therewith.

* * * * *